US011028618B1

(12) United States Patent
Liu

(10) Patent No.: US 11,028,618 B1
(45) Date of Patent: Jun. 8, 2021

(54) ELECTRONIC PADLOCK

(71) Applicant: DONGGUAN QINGXI KWONG WAH LOCK MFY. CO. LTD., Guangdong (CN)

(72) Inventor: Man Leung Thomas Liu, Guangdong (CN)

(73) Assignee: DONGGUAN QINGXI KWONG WAH LOCK MFY. CO. LTD., Dongguan (CN)

( * ) Notice: Subject to any disclaimer, the term of this patent is extended or adjusted under 35 U.S.C. 154(b) by 479 days.

(21) Appl. No.: 16/092,213

(22) PCT Filed: Apr. 18, 2018

(86) PCT No.: PCT/CN2018/083477

§ 371 (c)(1),
(2) Date: Oct. 8, 2018

(87) PCT Pub. No.: WO2019/200554

PCT Pub. Date: Oct. 24, 2019

(51) Int. Cl.

| | |
|---|---|
| ***E05B 67/38*** | (2006.01) |
| ***G07C 9/00*** | (2020.01) |
| ***E05B 47/00*** | (2006.01) |

(52) U.S. Cl.

CPC ..... *E05B 67/38* (2013.01); *E05B 47/0001* (2013.01); *G07C 9/00674* (2013.01); *G07C 9/00944* (2013.01); *E05B 2047/0024* (2013.01); *E05B 2047/0058* (2013.01); *G07C 2009/00642* (2013.01)

(58) Field of Classification Search

CPC ..... E05B 67/38; E05B 47/0001; E05B 2047/0024; E05B 2047/0058; E05B 47/0012; E05B 2047/0017; E05B 2047/0037; E05B 2047/0086; E05B 67/24;

(Continued)

(56) References Cited

U.S. PATENT DOCUMENTS 2,904,985 A * 9/1959 Murphy ..... E05B 17/002 70/51
4,224,813 A * 9/1980 Hampton ..... E05B 17/002 70/51

(Continued)

FOREIGN PATENT DOCUMENTS

CN 206707468 U 12/2017
CN 207194662 U 4/2018

*Primary Examiner* — Lloyd A Gall

(57) ABSTRACT

An electronic padlock comprising a lock body, a locking hook moveably connected to the lock body, and an unlocking assembly, a locking mechanism, and a mechanical unlocking system and an electronic unlocking system which are provided in the lock body. One end of the mechanical unlocking system and one end of the electronic unlocking system are movably connected to the unlocking assembly to drive the unlocking assembly to perform position conversion between a first position and a second position, respectively; a locking mechanism is defined at the unlocking assembly, when the unlocking assembly is in the first position, the locking mechanism limits a position of the locking hook, the electronic padlock is in a locked state; when the unlocking assembly is in the second position, the locking mechanism is disengaged inwardly from the locking hook so that the locking hook can be pulled out to unlock the electronic padlock.

17 Claims, 6 Drawing Sheets

(58) Field of Classification Search
CPC ..... E05B 67/02; G07C 9/00944; G07C 2009/00642
USPC ..... 70/38 R, 38 A, 38 B, 38 C, 39, 277, 70/278.1, 278.2, 278.3, 278.7, 279.1, 70/379 R, 379 A, 380
See application file for complete search history.

(56) References Cited

U.S. PATENT DOCUMENTS 5,561,996 A * 10/1996 Chang ..... B60R 25/066 70/247
6,401,501 B1 * 6/2002 Kajuch ..... E05B 67/22 63/38
6,761,051 B1 * 7/2004 Tsai ..... E05B 47/0012 70/257
7,382,250 B2 * 6/2008 Marcelle ..... E05B 47/0012 340/5.22
7,581,423 B2 * 9/2009 Brojanac ..... E05B 17/002 70/423
8,453,481 B2 * 6/2013 Meekma ..... E05B 47/0012 70/38 A
9,540,845 B1 * 1/2017 Yang ..... E05B 19/0005
9,556,651 B1 1/2017 Cabral Herrera
2004/0055342 A1 * 3/2004 Chen ..... E05B 17/002 70/56
2006/0283216 A1 * 12/2006 Marcelle ..... G07C 9/00182 70/38 A
2011/0265526 A1 * 11/2011 Zuraski ..... E05B 67/003 70/18
2012/0324967 A1 * 12/2012 Goren ..... E05B 47/0603 70/280
2015/0225986 A1 * 8/2015 Goldman ..... E05B 67/02 70/20
2019/0156607 A1 * 5/2019 Tao ..... G07C 9/00563
2021/0047865 A1 * 2/2021 Tsui ..... E05B 47/00

* cited by examiner

ELECTRONIC PADLOCK

FIELD OF THE INVENTION

The present application relates to a technical field of a lock, and more particularly relates to an electronic padlock.

BACKGROUND OF THE INVENTION

With continuous introduction of high-tech to traditional locks, security function of locks has been fully extended and expanded. An electronic padlock has become an indispensable team member in today's security systems of security class, and its status and role cannot be replaced by any mechanical locks. The existing electronic padlock generally has a fingerprint, a password, and a mechanical key opening function. When a double-guaranteed electronic system fails, it can also be unlocked with a third-guaranteed mechanical key to improve safety. However, at present, the electronic padlock has an unreasonable structural design on a dual operating system of the electronic system and the mechanical key, and the installation is complicated, resulting in an increase in cost, and it cannot be widely applied.

SUMMARY OF THE INVENTION

In order to solve the above problems of the prior art, embodiments of the present invention provide an electronic padlock with reasonable structure design and simple installation. The technical solution is as follows: in one aspect, an embodiment of the present invention provides an electronic padlock comprising: a lock body, a locking hook moveably connected to the lock body, and an unlocking assembly, a locking mechanism, a mechanical unlocking system and an electronic unlocking system which are defined in the lock body, one end of the mechanical unlocking system and one end of the electronic unlocking system are movably connected to the unlocking assembly, respectively, the unlocking assembly and the mechanical unlocking system are located on a same central axis and are defined up and down relative to each other, a central axis of the electronic unlocking system and a central axis of the unlocking assembly are defined at a predetermined angle, the mechanical unlocking system and the electronic unlocking system are respectively applied to drive the unlocking assembly to perform a position conversion between a first position and a second position;

the locking mechanism is defined at an end of the unlocking assembly, when the unlocking assembly is in the first position, the locking mechanism limits a position of the locking hook, the electronic padlock is in a locked state; when the unlocking assembly is in the second position, the locking mechanism can be disengaged inwardly from the locking hook so that the locking hook can be pulled out to unlock the electronic padlock.

In the electronic padlock according to the embodiment of the present invention, the unlocking assembly comprises a transmission rod, a transmission frustum and a toggle switch which are arranged along a central axis of the mechanical unlocking system, one end of the transmission rod is movably connected to the mechanical unlocking system, and the other end of the transmission rod is provided with a toggle switch, the mechanical unlocking system is applied to drive the toggle switch on the transmission rod to rotate between the first position and the second position;

The transmission frustum is elastically sleeved on the transmission rod, and the transmission frustum is intermittently and rotationally matched with the electronic unlocking system, and the electronic unlocking system is applied to drive the transmission frustum to drive the toggle switch on the transmission rod to rotate between the first position and the second position; and When the toggle switch rotates to the first position, the toggle switch abuts against the locking mechanism; when the toggle switch rotates to the second position, the toggle switch is spaced apart from the locking mechanism by a withdrawal space, the locking mechanism can be disengaged from the locking hook along the withdrawal space.

In the electronic padlock according to the embodiment of the present invention, the transmission rod protrudes in its radial direction to form a mounting portion, a first buckle position is defined on the mounting portion, a second buckle position is arranged on the transmission frustum, a torsion spring is connected between the first buckle position and the second buckle position, the torsion spring is axially extended along the transmission rod for resetting the toggle switch after an external force of the mechanical unlocking system disappears.

In the electronic padlock according to the embodiment of the present invention, an inner wall of the transmission frustum is stepwise reduced in a direction opposite to the mounting portion to form a first step portion, a second step portion, and a third step portion, an inner wall of the first step portion is in clearance fit with the mounting portion, an inner wall of the second step portion is in clearance fit with the torsion spring, and an inner wall of the third step portion is in clearance fit with the transmission rod.

In the electronic padlock according to the embodiment of the present invention, the mounting portion protrudes toward the transmission frustum to form a sliding block, a sliding groove slidably fitted with the sliding block is defined on a top portion of the second step portion;

When the mechanical unlocking system drives the toggle switch to rotate from the first position to the second position by an external force, the sliding block slides along the sliding groove, the transmission frustum is intermittently and rotatably matched with the electronic unlocking system and is stationary, the torsion spring is forced to contract; when the external force of the mechanical unlocking system disappears, an elastic force of the torsion spring drives the toggle switch to rotate from the second position to the first position; and When the electronic unlocking system drives the transmission frustum to rotate, the sliding groove abuts against the sliding block to push the sliding block to rotate, thereby driving the toggle switch to rotate from the first position to the second position or from the second position to the first position.

In the electronic padlock according to the embodiment of the present invention, the mechanical unlocking system comprises a lock cylinder axially defined along the transmission rod, a lock cylinder block is defined at one end of the lock cylinder, the end of the lock cylinder is close to the transmission rod; and one end of the lock cylinder is applied for inserting a key to apply an external force, the end of the lock cylinder is opposite to the transmission rod;

The lock cylinder block is provided with two fan-shaped push grooves symmetrically arranged and communicated with each other, the transmission rod extends toward the fan-shaped push grooves to provide a transmission plate, the fan-shaped push grooves is applied for pushing the transmission plate to rotate; and A central angle of one fan-shaped push slot is greater than or equal to a rotation angle of the toggle switch from the first position to the second position; when the electronic unlocking system drives the transmission rod to rotate to complete a position conversion of the toggle switch, the transmission plate idles in the fan-shaped pushing grooves.

In the electronic padlock according to the embodiment of the present invention, a first circular arc portion, a transmission groove, and a second circular arc portion are defined along a circumferential direction of the transmission frustum, the first circular arc portion, the transmission groove and the second circular arc portion are sequentially defined at intervals.

In the electronic padlock according to the embodiment of the present invention, the electronic unlocking system comprises a motor and a motor block defined on a drive shaft of the motor;

The motor block protrudes to form a drive cam, an outer peripheral wall of the drive cam comprises a first contour and a second contour which are closed to each other, and the second contour is matched with the first circular arc portion and the second circular arc portion;

A driving column spaced apart from the first contour is provided on the motor block so that when the motor drives the motor block to rotate, the drive column enters the transmission groove to rotate the transmission frustum; and When the transmission frustum is rotated from the first position to the second position, the second contour is rotated from a position abutting against the first circular arc portion to a position abutting against the second circular arc portion; when the transmission frustum is rotated from the second position to the first position, the second contour is rotated from a position abutting against the second circular arc portion to a position abutting against the first circular arc portion to achieve an intermittent rotation and fitting between the transmission frustum and the motor block.

In the electronic padlock according to the embodiment of the present invention, the torsion spring comprises a torsion spring body extending axially around the transmission rod, and a first leg and a second leg formed by bending ends of the torsion spring body, respectively, the first leg is snap-fitted with the first buckle position, and the second leg is snap-fitted with the second buckle position.

In the electronic padlock according to the embodiment of the present invention, the locking mechanism comprises an elastic member, and a first dial member and a second dial member defined on two sides of the toggle switch, respectively, the elastic member comprises a spiral elastic body, and a first elastic arm and a second elastic arm which are extended along two ends of the elastic body toward the first dial member and the second dial member, respectively; and The first dial member and the second dial member move along the withdrawal space to disengage from the locking hook, the elastic member is squeezed to contract; when the locking hook is inserted into the lock body, the first dial member and the second dial member are pushed back to an initial position by a resilient force of the elastic member to limit a position of the locking hook.

In the electronic padlock according to the embodiment of the present invention, the first dial member is cylindrical, the second dial member is in a cubic shape, and the second dial member protrudes toward the locking hook to form a hemispherical convex portion; and The locking hook is U-shaped with unequal end lengths, a first concave position is defined on a longer end of the locking hook, the first concave position is matched with the first dial member; a second concave position is defined on a shorter end of the locking hook, the second concave position is matched with the convex portion to prevent the locking hook from being pulled out of the lock body when being locked.

In the electronic padlock according to the embodiment of the present invention, the electronic unlocking system further comprises:

A password identification module for identifying an user's password to unlock the electronic padlock and send an unlocking signal;

A fingerprint recognition module for identifying an user's biometric fingerprint to unlock the electronic padlock and send an unlocking signal; and A wireless communication module for establishing a wireless communication connection with a mobile device to receive a control command from the mobile device.

In the electronic padlock according to the embodiment of the present invention, the lock body further comprises:

A travel switch mounted on the longer end of the locking hook for identifying whether the electronic padlock is in an unlocked state, when the electronic padlock is in the unlocked state, the travel switch is also applied to produce a locking signal after the locking hook is inserted to a predetermined position in the lock body;

A microcontroller electrically connected to the motor, the password identification module, the fingerprint recognition module, the wireless communication module and the travel switch and applied for receiving a unlocking signal or a the locking signal, and then driving the motor to rotate according to the unlocking signal and the locking signal;

The battery electrically connected to the microcontroller for providing electrical power;

A function switch electrically connected to the battery for starting the battery to provide the electrical power, the function switch is also applied to switch unlocking modes of the electronic unlocking system;

An USB interface electrically connected to the battery for receiving an external power supply to charge the battery.

In the electronic padlock according to the embodiment of the present invention, the lock body comprises a lock main body having an inner cavity, and a cover detachably mounted on the lock main body, the cover is provided with a fingerprint module installation hole for installing the fingerprint recognition module and a function switch installation hole for installing the function switch.

On the other hand, the present invention also provides an electronic padlock with a waterproof function comprising a lock body, a locking hook moveably connected to the lock body, and an unlocking assembly, a locking mechanism, a mechanical unlocking system and an electronic unlocking system which are defined in the lock body, one end of the mechanical unlocking system and one end of the electronic unlocking system are movably connected to the unlocking assembly, respectively, the unlocking assembly and the mechanical unlocking system are located on a same central axis and are defined up and down relative to each other, a central axis of the electronic unlocking system and a central axis of the unlocking assembly are defined at a predetermined angle, the mechanical unlocking system and the electronic unlocking system are respectively applied to drive the unlocking assembly to perform position conversion between a first position and a second position;

A locking mechanism is defined at an end of the unlocking assembly, when the unlocking assembly is in the first position, the locking mechanism limits a position of the locking hook, the electronic padlock is in a locked state; when the unlocking assembly is in the second position, the locking mechanism can be disengaged inwardly from the locking hook so that the locking hook can be pulled to unlock the electronic padlock; and The waterproof system comprises several waterproof devices and drainage devices provided in the lock body.

In the electronic padlock with a waterproof function according to the embodiment of the present invention, the locking mechanism comprises a first dial member and a second dial member defined on two sides of the unlocking assembly respectively; the second dial member protrudes toward the locking hook to form a convex portion, and an annular groove is defined between the second dial member and the convex portion; and A waterproof device comprises a first waterproof ring sleeved on an annular groove, and an outer surface of the first waterproof ring protrudes from the annular groove for sealing and connecting the second dial member and the lock body.

In the electronic padlock with a waterproof function according to the embodiment of the present invention, the lock body comprises a lock main body having an inner cavity, and a cover detachably mounted on the lock main body; a first locking hook mounting position and a second locking hook mounting position for limiting the locking hook are also arranged in the lock body;

The waterproof device further comprises a second waterproof ring embedded in inner walls of the first locking hook mounting position and the second locking hook mounting position, respectively, and the second waterproof ring is applied for sealing and connecting the lock main body and the locking hook.

One or more technical solutions provided by the present invention have at least the following technical effects or advantages: in the electronic padlock provided by the present invention, the unlocking assembly is shared by the mechanical unlocking system and the electronic unlocking system, and operation independence of the mechanical unlocking system and the electronic unlocking system can also be ensured respectively at the same time, the structural design is ingenious, and well user experience and use safety are ensured.

BRIEF DESCRIPTION OF THE DRAWINGS

The present invention will be further described below with reference to the accompanying drawings and embodiments. In the drawings.

DETAILED DESCRIPTION OF THE PREFERRED EMBODIMENT

In order that those skilled in the art can more clearly understand the present invention, the present invention will be further described in detail below and in conjunction with the accompanying drawings and specific embodiments.

Figure 1:
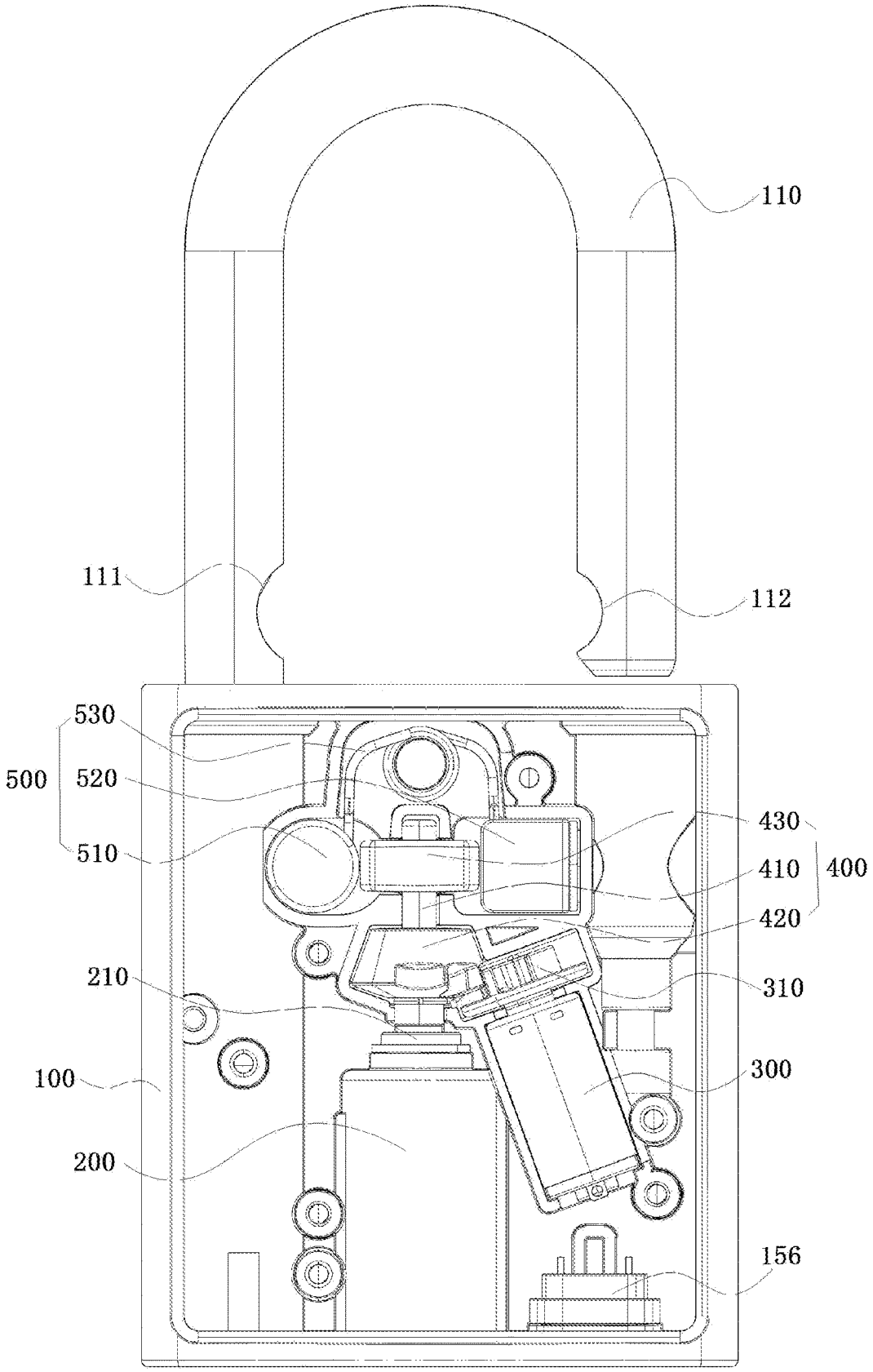
FIG. 1 is a sectional view of an electronic padlock provided by an embodiment of the present invention.

As shown in FIG. 1, an embodiment of the present invention provides an electronic padlock, comprising a lock body 100, a locking hook 110 moveably connected to the lock body 100, and an unlocking assembly 400, a locking mechanism 500, a mechanical unlocking system and an electronic unlocking system which are provided in the lock body 100. One end of the mechanical unlocking system and one end of the electronic unlocking system are movably connected to the unlocking assembly 400, respectively. The unlocking assembly 400 and the mechanical unlocking system are located on a same central axis and are defined up and down relative to each other. A central axis of the electronic unlocking system and a central axis of the unlocking assembly 400 are defined at a predetermined angle.

The unlocking assembly 400 comprises a transmission rod 410, a transmission frustum 420 and a toggle switch 430 which are arranged along a central axis of the mechanical unlocking system. One end of the transmission rod 410 is movably connected to the mechanical unlocking system, and the other end of the transmission rod 410 is provided with a toggle switch 430. The mechanical unlocking system is used to drive the toggle switch 430 on the transmission rod 410 to rotate between the first position and the second position; the transmission frustum 420 is elastically sleeved on the transmission rod 410, and the transmission frustum 420 is intermittently and rotationally matched with the electronic unlocking system, and the electronic unlocking system is used to drive the transmission frustum 420 to drive the toggle switch 430 on the transmission rod 410 to rotate between the first position and the second position.

Specifically, when the toggle switch 430 rotates to the first position, two ends of the toggle switch 430 in the longitudinal direction abut against the locking mechanism 500, the position of the locking hook 110 is limited by the locking mechanism 500, and the electronic padlock is in a locking state; When the toggle switch 430 rotates to the second position, two ends of the toggle switch 430 in the width direction are spaced apart from the locking mechanism 500 by a withdrawal space. The locking mechanism 500 can disengage the locking hook 110 along the withdrawal space to make the locking hook 110 can be pulled out to unlock. The electronic padlock provided by the invention can be unlocked by the mechanical unlocking system and the electronic unlocking system at the same time, and the operation is convenient and the safety is guaranteed. Meanwhile, the mechanical unlocking system and the electronic unlocking system share an unlocking assembly 400, so that the electronic padlock has a compact structure and high space utilization.

Figure 2:
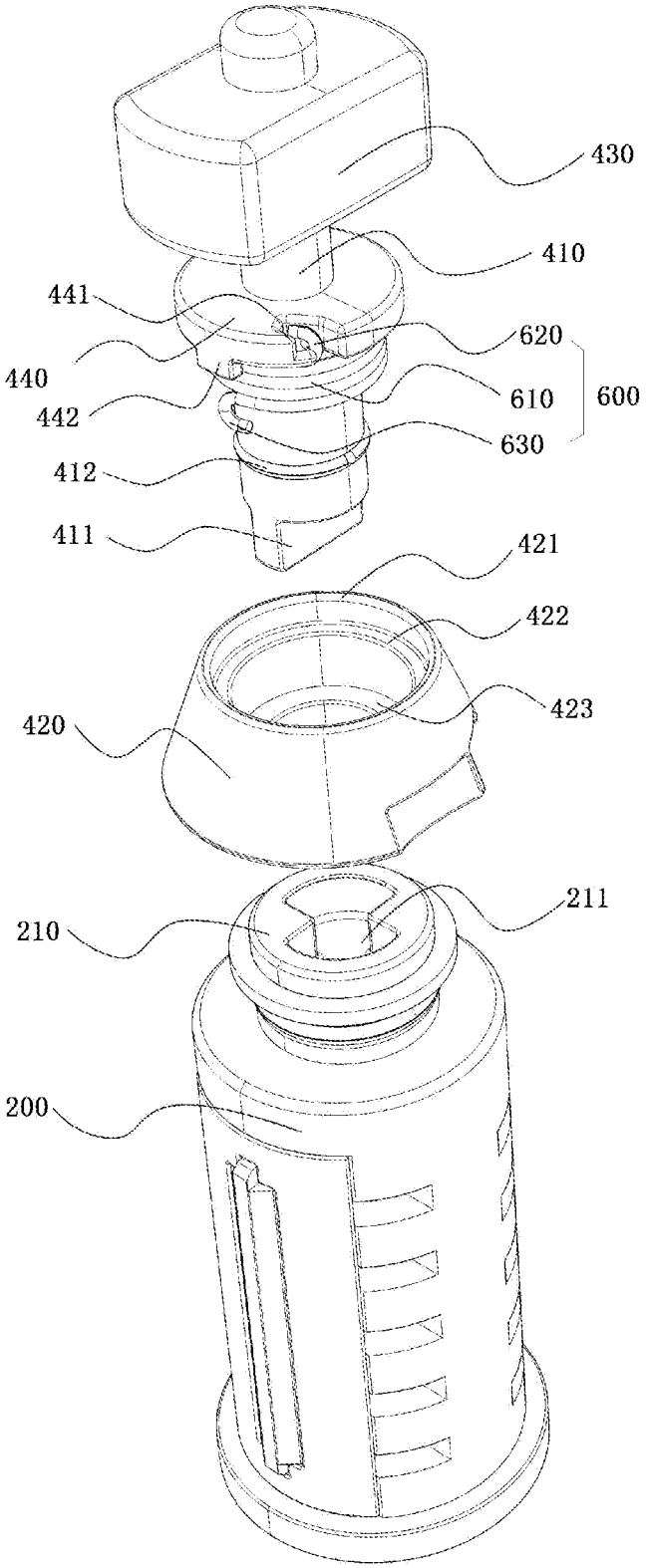
FIG. 2 is an exploded view of the unlocking assembly and mechanical unlocking system of FIG. 1.
Figure 3:
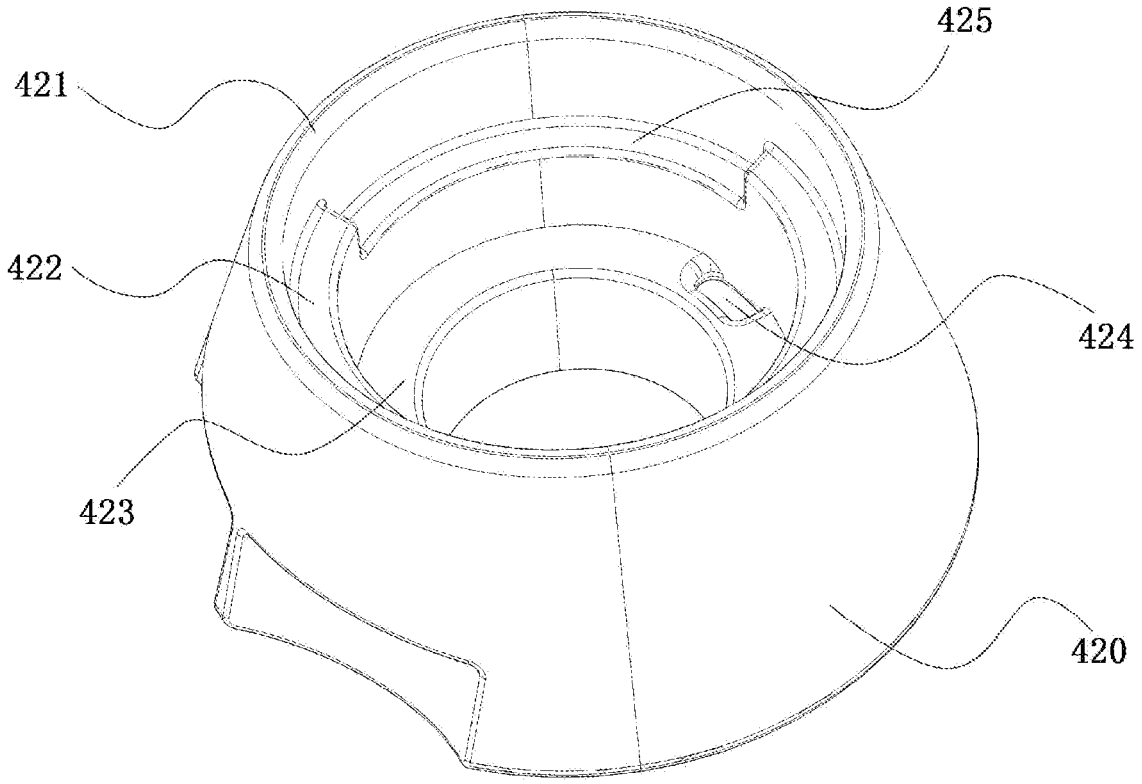
FIG. 3 is a schematic structural view of a transmission frustum in FIG. 1.

As shown in FIG. 1 and FIG. 2, in the present embodiment, the toggle switch 430 has a rectangular shape, and the toggle switch 430 and the transmission rod 410 are integrally formed. One end of the transmission rod 410 close to the toggle switch 430 protrudes in a radial direction to define a mounting portion 440. The mounting portion 440 is provided with a first buckle position 441 in a stepped shape, and a second buckle position 424 (See FIG. 3 for details) is defined on the transmission frustum 420. A torsion spring 600 is connected between the first buckle position 441 and the second buckle position 424 so as to realize an elastic sleeve connection between the transmission frustum 420 and the transmission rod 410. The torsion spring 600 comprises a torsion spring body 610 extending axially around the transmission rod 410, and a first leg 620 and a second leg 630 formed by bending ends of the torsion spring body 610, respectively, the first leg 620 is snap-fitted with the first buckle position 441, and the second leg 630 is snap-fitted with the second buckle position 424 (see FIG. 4 for details).

The transmission frustum 420 is in the form of a ring table, and an inner wall of the transmission frustum 420 is stepwise reduced in a direction away from the mounting portion 440 to form a first step portion 421, a second step portion 422, and a third step portion 423, therein an inner wall of the first step portion 421 is in clearance fit with the mounting portion 440. An inner wall of the second step portion 422 is in clearance fit with the torsion spring 600, and an inner wall of the third step portion 423 is in clearance fit with the transmission rod 410.

One end of the transmission rod 410 close to the mechanical unlocking system is also sleeved with a limiting ring 412. An outer diameter of the limiting ring 412 is larger than an inner diameter of the third step portion 423, so as to limit a position of the transmission frustum 420 to prevent the transmission frustum 420 from being fallen out.

A bottom part of the mounting portion 440 protrudes toward the transmission frustum 420 to form a sliding block 442. A sliding groove 425 (see FIG. 3 for details) being slidably fitted with the sliding block 442 is defined on the top of the second step portion 422; When the mechanical unlocking system drives the toggle switch 430 to rotate from the first position to the second position under the action of an external force, the sliding block 442 slides along the sliding groove 425, since the transmission frustum 420 is intermittently and rotatably matched with the electronic unlocking system. The transmission frustum 420 is stationary, which means that, the first leg 620 of the torsion spring 600 is rotating, and the second leg 630 is not moved, and the torsion spring 600 is forced to contract; when the external force of the mechanical unlocking system disappears, an elastic force of the torsion spring 600 drives the toggle switch 430 to rotate from the second position to the first position to realize an automatic reset of the toggle switch 430. In the present embodiment, the intermittent and rotational engagement of the transmission frustum and the electronic unlocking system utilizes the Geneva Cam Principle, which is no longer to be explained in detail.

When the electronic unlocking system drives the transmission frustum 420 to rotate, one end of the sliding groove 425 abuts against the sliding block 442 to push the sliding block 442 to rotate, thereby driving the toggle switch 430 to rotate from the first position to the second position or from the second position to the first position to achieve the purpose of sharing one unlocking assembly 400 between the mechanical unlocking system and the electronic unlocking system.

In this embodiment, the mechanical unlocking system comprises a lock cylinder 200 axially defined along the transmission rod 410. A lock cylinder block 210 is defined at one end of the lock cylinder 200 close to the transmission rod 410, and one end of the lock cylinder 200 which is opposite to the transmission rod 410 is applied for inserting a key to apply an external force;

The lock cylinder block 210 is provided with two fan-shaped push grooves 211 symmetrically arranged and communicated with each other. The transmission rod 410 extends toward the fan-shaped push grooves 211 to provide a transmission plate 411. The fan-shaped push grooves 211 push the transmission plate 411 to rotate by abutting against the transmission plate 411 during rotation.

A central angle of one fan-shaped push slot 211 is greater than or equal to a rotation angle of the toggle switch 430 from the first position to the second position. In this embodiment, the rotation angle of the toggle switch 430 rotated from the first position to the second position is 90°, that is, the degree of the central angle of the fan-shaped push groove 211 is greater than 90°. When the position of the toggle switch is switched by the rotation of the electronic unlocking system driving transmission rod 410, the transmission plate 411 idles from one side wall of the fan-shaped pushing groove 211 to the other side wall of the fan-shaped pushing groove 211, and the lock cylinder 200 is stationary, thus ensuring that the electronic unlocking system and the mechanical unlocking system are independent of each other, without affecting the user experience.

Figure 4:
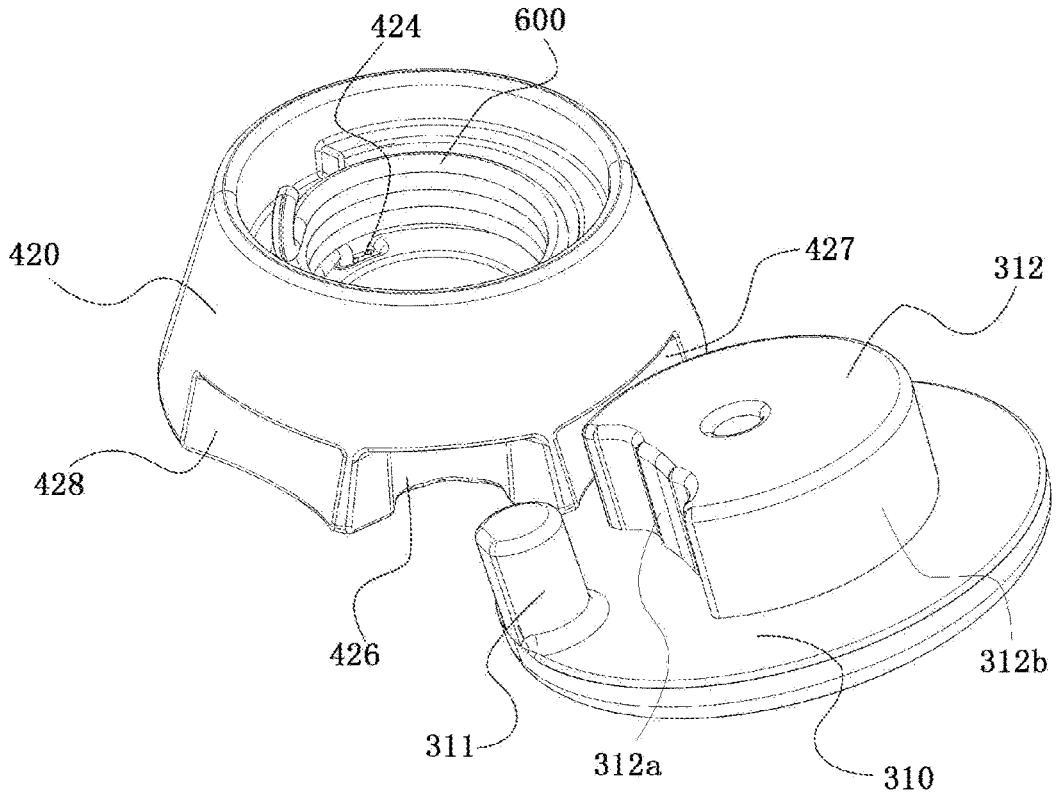
FIG. 4 is a schematic view of an assembly structure of the transmission frustum and the motor block FIG. 1.

As shown in FIG. 1 and FIG. 4, in the present embodiment, the electronic unlocking system comprises a motor 300 and a motor block 310. A central hole is defined in the motor block 310, and the motor block 310 is sleeved on the drive shaft of the motor 300 through the central hole. When the drive shaft of the motor 300 rotates, the motor block 310 is driven to rotate.

A first circular arc portion 427, a transmission groove 426, and a second circular arc portion 428 are defined in turn along a circumferential direction of the transmission frustum 420, therein a distance of the transmission groove 426 extended along a radial direction of the transmission frustum 420 is greater than a distance of the first arc portion 427 and the second arc portion 428 extended along a radial direction of the transmission cone 420.

An end of the motor block 310 opposite to the motor 300 protrudes to form a drive cam 312. An outer peripheral wall of the drive cam 312 comprises a first contour 312*a* and a second contour 312*b* that are closed to each other, and the second contour 312*b* is matched with the first arc portion 427 and the second circular arc portion 428, and the first contour 312*a* is generally wavy; an end of the motor block 310 opposite to the motor 300 is further convexly provided with the driving column 311 which is defined apart from the first contour 312*a*.

In the present embodiment, a transmission design of an intermittent and rotational match between the transmission frustum 420 and the motor block 310 is realized by the Geneva Cam. When the motor 300 drives the motor block 310 to rotate, a driving column 311 enters the transmission groove 426 to drive the transmission frustum 420 to rotate. When the transmission frustum 420 is rotated from the first position to the second position, the second contour 312*b* is rotated from a position abutting against the first arc portion 427 to a position abutting against the second arc portion 428; when the transmission frustum 420 is rotated from the second position to the first position, the second contour 312*b* is rotated from a position abutting against the second circular arc portion 428 to a position abutting against the first arc portion 427. In the above intermittent rotation and fitting process, the motor block 310 acts as a driving wheel and can drive the transmission frustum 420 to rotate. The transmission frustum 420 acts as a driven wheel and cannot drive the motor block 310 to rotate. That is, when the electronic padlock is unlocked by the mechanical unlocking system, the electronic unlocking system remains stationary and the two systems are independent.

Figure 5:
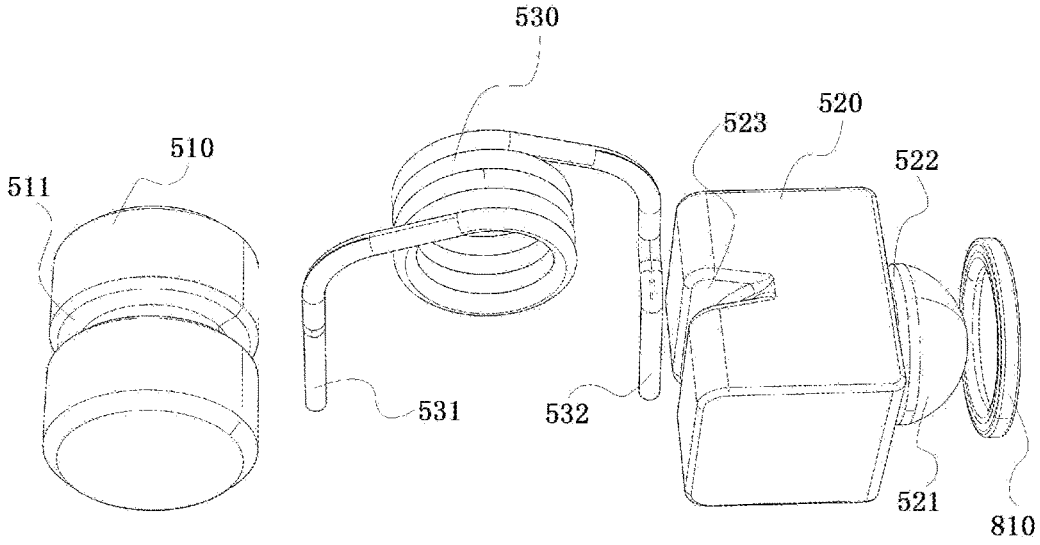
FIG. 5 is a schematic structural view of the locking assembly of FIG. 1.

Further, as shown in FIG. 1 and FIG. 5, the locking mechanism 500 comprises an elastic member 530, and a first dial member 510 and a second dial member 520 defined on two sides of the toggle switch 430, respectively. Therein the elastic member 530 comprises a spiral elastic body 530, and a first elastic arm 531 and a second elastic arm 532 which are extended along two ends of the elastic body 530 toward the first dial member 510 and the second dial member 520, respectively. A first elastic limit slot 511 is arranged around the first dial member 510, and a second elastic limit slot 523 is defined on a side wall of the second dial member 520 opposite to the first dial member 510. The first elastic arm 531 is engaged with the first elastic limit slot 511, and the second elastic arm 532 is engaged with the second elastic limit slot 523.

When the toggle switch 430 is located at the second position, the first dial member 510 and the second dial member 520 move inwardly along the withdrawal space to release the locking hook 110, the elastic member 530 is squeezed to contract and collect a force. When the user inserts the locking hook 110 into the lock body 100, the first dial member 510 and the second dial member 520 are pushed back to an initial position by a resilient force of the elastic member 530 to limit the position of the locking hook 110. Since the toggle switch 430 is used to space the first dial 510 and the second dial 520 with the withdrawal space, the toggle switch 430 can be easily rotated from the second position to the first position, and power can be saved while reducing the resistance.

In this embodiment, the first dial member 510 is substantially cylindrical, the second dial member 520 is generally in a cubic shape, and the second dial member 520 protrudes toward the locking hook 110 to form a hemispherical convex portion 521.

The locking hook 110 is substantially U-shaped with unequal end lengths. A first concave position 111 is defined on a longer end of the locking hook 110. The first concave position 111 matches with a contour of a peripheral wall of the first dial member 510. A second concave position 112 is defined on a shorter end of the locking hook 110. The second concave position 112 is matched with a contour of a convex portion 521. The first dial member 510 snaps into the first concave position 111 and the second dial member 520 snaps into the second concave position 112 when the locking hook 110 is inserted into the lock body 100, so that to prevent the locking hook 110 from being pulled out of the lock body 100 when being locked.

Figure 6:
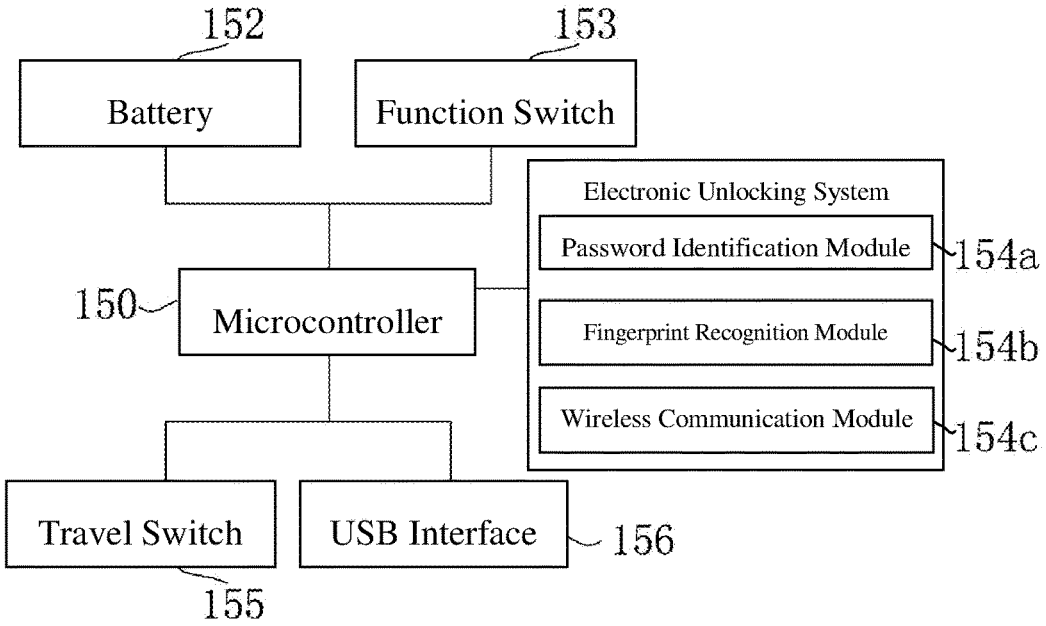
FIG. 6 is a schematic diagram of an electrical component connection provided by an embodiment of the present invention.

Further, as shown in FIG. 1 and FIG. 6, the electronic unlocking system further comprises a password identification module 154*a* for identifying an user's password to unlock the electronic padlock and sending an unlocking signal, a fingerprint recognition module 154*b* for identifying an user's biometric fingerprint to unlock the electronic padlock and send an unlocking signal, and a wireless communication module 154*c* for establishing a wireless communication connection with a mobile device to receive a control command from the mobile device. Through the wireless communication connection, the user can unlock or lock the electronic padlock through an APP on the mobile device, as well as various other settings, thereby enriching operability and versatility of the electronic padlock.

The lock body 100 further comprises: a travel switch 155, a microcontroller 150, a battery 152, a function switch 153 and an USB interface 156. The travel switch 155 mounted on the longer end of the locking hook 110 for identifying whether the electronic padlock is in an unlocked state. When the electronic padlock is in the unlocked state, the travel switch 155 is also used to produce a locking signal after the locking hook 110 is inserted to a predetermined position in the lock body 100; the microcontroller 150 electrically connected to the motor 300, the password identification module 154*a*, the fingerprint recognition module 154*b*, the wireless communication module 154*c* and the travel switch 155, and the microcontroller 150 receives the unlocking signal or the locking signal, and driving the motor 300 to perform rotational motion in different directions according to the unlocking signal and a locking signal; the battery 152 is electrically connected to the microcontroller 150 for providing electric energy; a function switch 153 is electrically connected to the battery 152 and the function switch 153 is used to start the battery 152 to provide electrical power. At the same time, the function switch 153 is also used to switch unlocking modes of the electronic unlocking system; an USB interface 156 is electrically connected to the battery 152 and is used for receiving an external power supply to charge the battery 152. Meanwhile, The USB interface 156 also receives an user-entered parameter to reset parameters of the electronic unlocking system.

Figure 7:
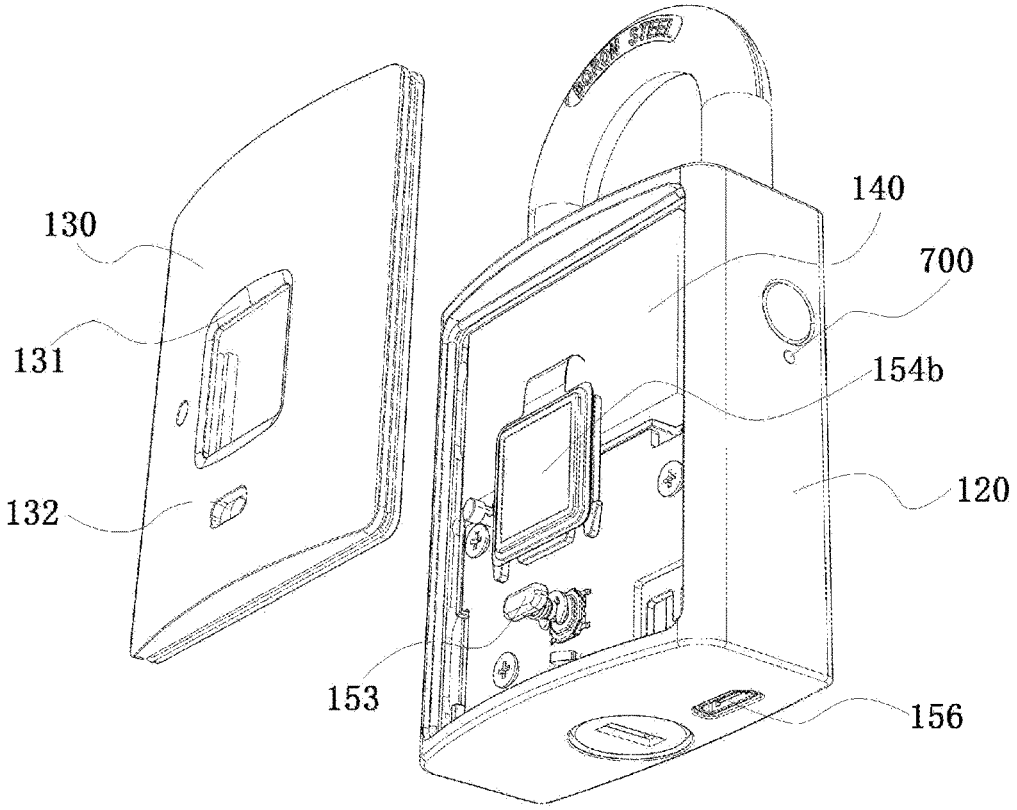
FIG. 7 is a schematic exploded view of an electronic padlock provided by an embodiment of the present invention.

Further, as shown in FIG. 1 and FIG. 7, the lock body 100 comprises a lock main body 120 having an inner cavity, and a cover 130 detachably mounted on the lock main body 120. The cover 130 is provided with a fingerprint module installation hole 131 for installing the fingerprint recognition module 154*b* and a function switch installation hole 132 for installing the function switch 153; and a locking body mounting hole for connecting the lock core and a USB mounting hole for connecting the USB interface are defined on an end of the body 120 opposite to the locking hook 110;

A plurality of screw mounting positions are also defined in the lock main body 120, and a plurality of limiting plates 140 are also installed between the lock main body 120 and the cover 130. Each limiting plate 140 is fastened to the lock main body 120 through the screw mounting position.

Figure 8:
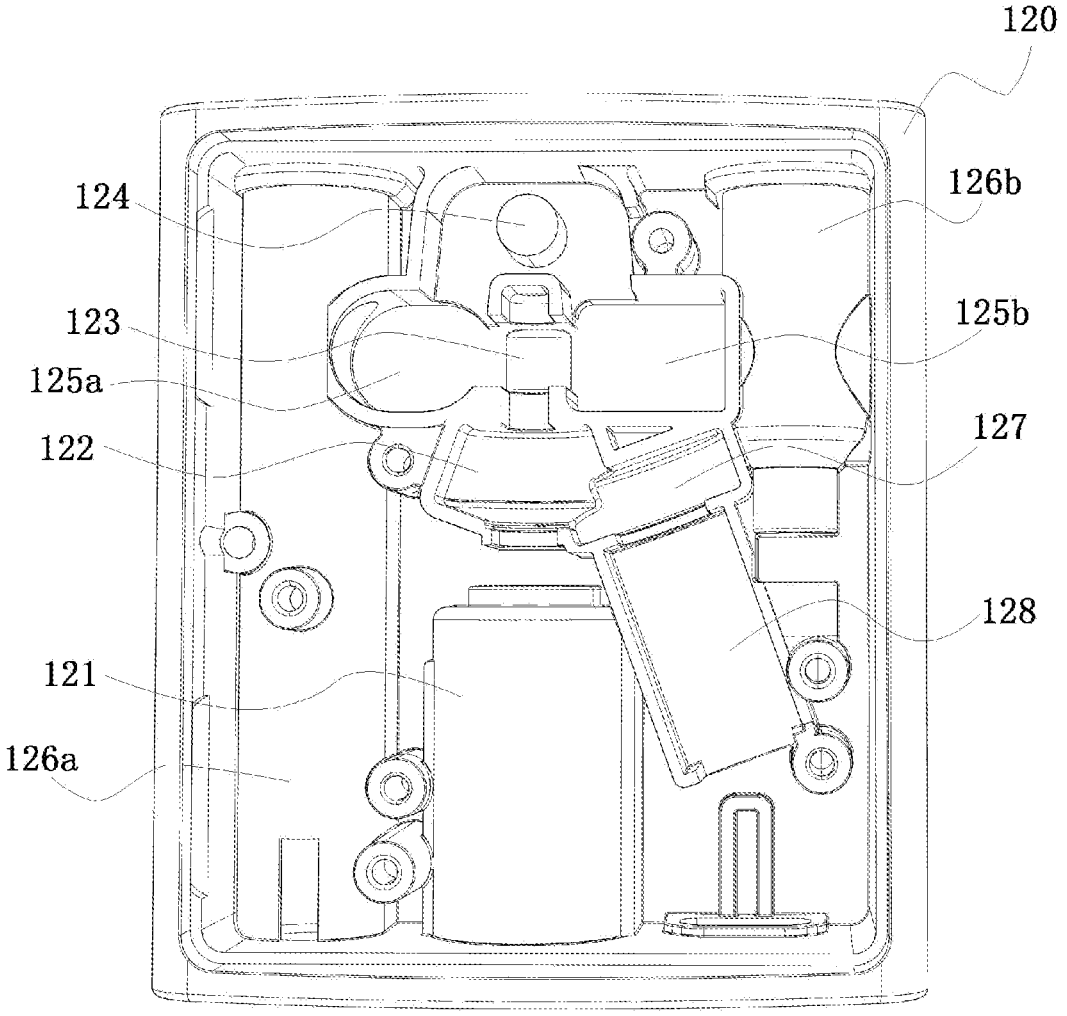
FIG. 8 is a schematic diagram of an internal structure of a lock body provided by an embodiment of the present invention.

Further, as shown in FIG. 1 and FIG. 8, a lock cylinder mounting position 121, a transmission frustum mounting position 122, a toggle switch mounting position 123, and an elastic member mounting column 124 are defined on the lock main body 120 in its axial direction. The transmission frustum mounting position 122 and the toggle switch mounting position 123 are communicated with each other to form a transmission rod mounting position; the lock main body 120 is also provided with a first dial mounting position 125*a* and a second dial mounting position 125*b* which are closely and respectively defined on two sides of the toggle switch mounting position 123, a first locking hook mounting position 126*a* defined proximate to the first dial mounting position 125*a*, a second locking hook mounting position 126*b* defined proximate to the second dial mounting position 125*b*, and a motor dial mounting position 127 and a motor mounting position 128 in oblique communication with the toggle switch mounting position 123; therein the first locking hook mounting position 126*a* and the second locking hook mounting position 126*b* are communicated to the first dial mounting position 125*a* and the second dial mounting position 125*b*, respectively and correspondingly. Through the limiting function of each limiting plate 140 and the mounting position, the mounting stability of components in the lock body can be ensured to the greatest extent, and assembly and disassembly are facilitated.

The Second Embodiment

In order to improve waterproof performance, the second embodiment of the present invention also provides an electronic padlock with waterproof function. The electronic padlock with the waterproof function is based on the electronic padlock of the first embodiment. The waterproof system is added on the electronic padlock of the first embodiment, and the waterproof system comprises several waterproof devices and drainage devices provided in the lock body 100.

As shown in FIG. 5 and FIG. 8, a waterproof device comprises a first waterproof ring 810 sleeved on an annular groove 522, and an outer surface of the first waterproof ring 810 protrudes from the annular groove 522 for sealing and connecting the second dial member 520 and the lock body 100; the waterproof device further comprises a second waterproof ring embedded on inner walls of a first locking hook mounting position 126*a* and a second locking hook mounting position 126*b*, respectively, and the second waterproof ring is used for sealing and connecting the lock main body 120 and the locking hook 110. Preferably, the second waterproof ring is fitted on inner walls of openings of the first locking hook mounting position 126*a* and the second locking hook mounting position 126*b*. Certainly, in the present embodiment, a waterproof device is defined at the lock cylinder mounting hole, the USB mounting hole, the fingerprint recognition module mounting hole 131, and the function switch mounting hole 132, which will not be described herein.

FIG. 7 and FIG. 8, the drainage device comprises a drainage hole 700 defined on a side wall of the lock main body 120. The drainage hole 700 is in communication with the second locking hook mounting position 126*b* for discharging the water in the second locking hook mounting position 126*b*.

In summary, the electronic padlock provided by the embodiment of the present invention uses both the mechanical unlocking system and the electronic unlocking system to increase the security of the electronic padlock, wherein the mechanical unlocking system and the electronic unlocking system share the unlocking assembly. It can guarantee the operation independence of the mechanical unlocking system and the electronic unlocking system, and the structure design is ingenious, ensuring a good user experience.

What is disclosed above is only a preferred embodiment of the present invention, and certainly cannot be used to limit the scope of rights of the present invention. Those skilled in the art can understand all or part of the processes for implementing the above embodiments, and according to the present invention, the equivalent change requested is still within the scope of the invention.

The invention claimed is:

1. An electronic padlock, comprising a lock body (100), a locking hook (110) moveably connected to the lock body (100), and an unlocking assembly (400), a locking mechanism (500), a mechanical unlocking system and an electronic unlocking system which are defined in the lock body (100), wherein one end of the mechanical unlocking system and one end of the electronic unlocking system are movably connected to the unlocking assembly (400), respectively, the unlocking assembly (400) and the mechanical unlocking system are located on a same central axis and are defined up and down relative to each other, a central axis of the electronic unlocking system and a central axis of the unlocking assembly (400) are defined at a predetermined angle, the mechanical unlocking system and the electronic unlocking system are respectively applied to drive the unlocking assembly (400) to perform a position conversion between a first position and a second position; and wherein a locking mechanism (500) is defined at an end of the unlocking assembly (400), when the unlocking assembly (400) is in the first position, the locking mechanism (500) limits a position of the locking hook (110), the electronic padlock is in a locked state; when the unlocking assembly (400) is in the second position, the locking mechanism (500) can be disengaged inwardly from the locking hook (110) so that the locking hook (110) can be pulled out to unlock the electronic padlock.

2. The electronic padlock according to claim 1, wherein the unlocking assembly (400) comprises a transmission rod (410), a transmission frustum (420) and a toggle switch (430) which are arranged along a central axis of the mechanical unlocking system, one end of the transmission rod (410) is movably connected to the mechanical unlocking system, and the other end of the transmission rod (410) is provided with the toggle switch (430), the mechanical unlocking system is applied to drive the toggle switch (430) on the transmission rod (410) to rotate between the first position and the second position;

wherein the transmission frustum (420) is elastically sleeved on the transmission rod (410), and the transmission frustum (420) is intermittently and rotationally matched with the electronic unlocking system, and the electronic unlocking system is applied to drive the transmission frustum (420) to drive the toggle switch (430) on the transmission rod (410) to rotate between the first position and the second position; and wherein when the toggle switch (430) rotates to the first position, the toggle switch (430) abuts against the locking mechanism (500); when the toggle switch (430) rotates to the second position, the toggle switch (430) is spaced apart from the locking mechanism (500) by a withdrawal space, the locking mechanism (500) can be disengaged from the locking hook (110) along the withdrawal space.

3. The electronic padlock according to claim 2, wherein the transmission rod (410) protrudes in its radial direction to form a mounting portion (440), a first buckle position (441) is defined on the mounting portion (440), a second buckle position (424) is arranged on the transmission frustum (420), a torsion spring (600) is connected between the first buckle position (441) and the second buckle position (424), the torsion spring (600) is axially extended along the transmission rod (410) for resetting the toggle switch (430) after an external force of the mechanical unlocking system disappears.

4. The electronic padlock according to claim 3, wherein an inner wall of the transmission frustum (420) is stepwise reduced in a direction opposite to the mounting portion (440) to form a first step portion (421), a second step portion (422), and a third step portion (423), an inner wall of the first step portion (421) is in clearance fit with the mounting portion (440), an inner wall of the second step portion (422) is in clearance fit with the torsion spring (600), and an inner wall of the third step portion (423) is in clearance fit with the transmission rod (410).

5. The electronic padlock according to claim 4, wherein the mounting portion (440) protrudes toward the transmission frustum (420) to form a sliding block (442), a sliding groove (425) slidably fitted with the sliding block (442) is defined on a top portion of the second step portion (422);

wherein when the mechanical unlocking system drives the toggle switch (430) to rotate from the first position to the second position by an external force, the sliding block (442) slides along the sliding groove (425), the transmission frustum (420) is intermittently and rotatably matched with the electronic unlocking system and is stationary, the torsion spring (600) is forced to contract; when the external force of the mechanical unlocking system disappears, an elastic force of the torsion spring (600) drives the toggle switch (430) to rotate from the second position to the first position; and wherein when the electronic unlocking system drives the transmission frustum (420) to rotate, the sliding groove (425) abuts against the sliding block (442) to push the sliding block (442) to rotate, thereby driving the toggle switch (430) to rotate from the first position to the second position or from the second position to the first position.

6. The electronic padlock according claim 5, wherein the mechanical unlocking system comprises a lock cylinder (200) axially defined along the transmission rod (410), a lock cylinder block (210) is defined at one end of the lock cylinder (200), the end of the lock cylinder (200) is close to the transmission rod (410); and one end of the lock cylinder (200) is applied for inserting a key to apply an external force, the end of the lock cylinder (200) is opposite to the transmission rod (410);

wherein the lock cylinder block (210) is provided with two fan-shaped push grooves (211) symmetrically arranged and communicated with each other, the transmission rod (410) extends toward the fan-shaped push grooves (211) to provide a transmission plate (411), the fan-shaped push grooves (211) is applied for pushing the transmission plate (411) to rotate; and wherein a central angle of one fan-shaped push groove (211) is greater than or equal to a rotation angle of the toggle switch (430) from the first position to the second position; when the electronic unlocking system drives the transmission rod (410) to rotate to complete a position conversion of the toggle switch (430), the transmission plate (411) idles in the fan-shaped push grooves (211).

7. The electronic padlock according claim 5, wherein a first circular arc portion (427), a transmission groove (426), and a second circular arc portion (428) are defined along a circumferential direction of the transmission frustum (420), the first circular arc portion (427), the transmission groove (426) and the second circular arc portion (428) are sequentially defined at intervals.

8. The electronic padlock according claim 7, wherein the electronic unlocking system comprises a motor (300) and a motor block (310) defined on a drive shaft of the motor (300);

wherein the motor block (310) protrudes to form a drive cam (312), an outer peripheral wall of the drive cam (312) comprises a first contour (312*a*) and a second contour (312*b*) which are closed to each other, and the second contour (312*b*) is matched with the first circular arc portion (427) and the second circular arc portion (428);

wherein a driving column (311) spaced apart from the first contour (312*a*) is provided on the motor block (310) so that when the motor (300) drives the motor block (310) to rotate, the drive column (311) enters the transmission groove (426) to rotate the transmission frustum (420); and wherein when the transmission frustum (420) is rotated from the first position to the second position, the second contour (312*b*) is rotated from a position abutting against the first circular arc portion (427) to a position abutting against the second circular arc portion (428); when the transmission frustum (420) is rotated from the second position to the first position, the second contour (312*b*) is rotated from a position abutting against the second circular arc portion (428) to a position abutting against the first circular arc portion (427) to achieve an intermittent rotation and fitting between the transmission frustum (420) and the motor block (310).

9. The electronic padlock according to claim 3, wherein the torsion spring (600) comprises a torsion spring body (610) extending axially around the transmission rod (410), and a first leg (620) and a second leg (630) formed by bending ends of the torsion spring body (610), respectively, the first leg (620) is snap-fitted with the first buckle position (441), and the second leg (630) is snap-fitted with the second buckle position (424).

10. The electronic padlock according to claim 2, wherein the locking mechanism (500) comprises an elastic member (530), and a first dial member (510) and a second dial member (520) defined on two sides of the toggle switch (430), respectively, the elastic member (530) comprises a spiral elastic body (530), and a first elastic arm (531) and a second elastic arm (532) which are extended along two ends of the elastic body (530) toward the first dial member (510) and the second dial member (520), respectively; and wherein the first dial member (510) and the second dial member (520) move along the withdrawal space to disengage from the locking hook (110), the elastic member (530) is squeezed to contract; when the locking hook (110) is inserted into the lock body (100), the first dial member (510) and the second dial member (520) are pushed back to an initial position by a resilient force of the elastic member (530) to limit a position of the locking hook (110).

11. The electronic padlock according to claim 10, wherein the first dial member (510) is cylindrical, the second dial member (520) is in a cubic shape, and the second dial member (520) protrudes toward the locking hook (110) to form a hemispherical convex portion (521); and wherein the locking hook (110) is U-shaped with unequal end lengths, a first concave position (111) is defined on a longer end of the locking hook (110), the first concave position (111) is matched with the first dial member (510); a second concave position (112) is defined on a shorter end of the locking hook (110), the second concave position (112) is matched with the convex portion (521) to prevent the locking hook (110) from being pulled out of the lock body (100) when being locked.

12. The electronic padlock according to claim 8, wherein the electronic unlocking system further comprises:

a password identification module (154*a*) for identifying an user's password to unlock the electronic padlock and send an unlocking signal;

a fingerprint recognition module (154*b*) for identifying an user's biometric fingerprint to unlock the electronic padlock and send an unlocking signal; and a wireless communication module (154*c*) for establishing a wireless communication connection with a mobile device to receive a control command from the mobile device.

13. The electronic padlock according to claim 12, wherein the lock body (100) further comprises:

a travel switch (155) mounted on the longer end of the locking hook (110) for identifying whether the electronic padlock is in an unlocked state, when the electronic padlock is in the unlocked state, the travel switch (155) is also applied to produce a locking signal after the locking hook (110) is inserted to a predetermined position in the lock body (100);

a microcontroller (150) electrically connected to the motor (300), the password identification module (154*a*), the fingerprint recognition module (154*b*), the wireless communication module (154*c*) and the travel switch (155) and applied for receiving a unlocking signal or a locking signal, and then driving the motor (300) to rotate according to the unlocking signal and the locking signal;

the battery (152) electrically connected to the microcontroller (150) for providing electrical power;

a function switch (153) electrically connected to the battery (152) for starting the battery (152) to provide the electrical power, the function switch (153) is also applied to switch unlocking modes of the electronic unlocking system;

an USB interface (156) electrically connected to the battery (152) for receiving an external power supply to charge the battery (152).

14. The electronic padlock according to claim 13, wherein the lock body (100) comprises a lock main body (120) having an inner cavity, and a cover (130) detachably mounted on the lock main body (120), the cover (130) is provided with a fingerprint module installation hole (131) for installing the fingerprint recognition module (154*b*) and a function switch installation hole (132) for installing the function switch (153).

15. An electronic padlock with a waterproof function comprising a lock body (100), a locking hook (110) moveably connected to the lock body (100), and an unlocking assembly (400), a locking mechanism (500), a mechanical unlocking system and an electronic unlocking system which are defined in the lock body (100), wherein one end of the mechanical unlocking system and one end of the electronic unlocking system are movably connected to the unlocking assembly (400), respectively, the unlocking assembly (400) and the mechanical unlocking system are located on a same central axis and are defined up and down relative to each other, a central axis of the electronic unlocking system and a central axis of the unlocking assembly (400) are defined at a predetermined angle, the mechanical unlocking system and the electronic unlocking system are respectively applied to drive the unlocking assembly (400) to perform position conversion between a first position and a second position;

wherein a locking mechanism (500) is defined at an end of the unlocking assembly (400), when the unlocking assembly (400) is in the first position, the locking mechanism (500) limits a position of the locking hook (110), the electronic padlock is in a locked state; when the unlocking assembly (400) is in the second position, the locking mechanism (500) can be disengaged inwardly from the locking hook (110) so that the locking hook (110) can be pulled out to unlock the electronic padlock; and wherein the waterproof system comprises several waterproof devices and drainage devices provided in the lock body (100).

16. The electronic padlock with a waterproof function according to claim 15, wherein the locking mechanism (500) comprises a first dial member (510) and a second dial member (520) defined on two sides of the unlocking assembly (400), respectively; the second dial member (520) protrudes toward the locking hook (110) to form a convex portion (521), and an annular groove (522) is defined between the second dial member (520) and the convex portion (521); and wherein a waterproof device comprises a first waterproof ring (810) sleeved on the annular groove (522), and an outer surface of the first waterproof ring (810) protrudes from the annular groove (522) for sealing and connecting the second dial member (520) and the lock body (100).

17. The electronic padlock with a waterproof function according to claim 15, wherein the lock body (100) comprises a lock main body (120) having an inner cavity, and a cover (130) detachably mounted on the lock main body (120); a first locking hook mounting position (126*a*) and a second locking hook mounting position (126*b*) for limiting the locking hook (110) are also arranged in the lock body (120); and wherein the waterproof device further comprises a second waterproof ring embedded in inner walls of the first locking hook mounting position (126*a*) and the second locking hook mounting position (126*b*), respectively, and the second waterproof ring is applied for sealing and connecting the lock main body (120) and the locking hook (110).

* * * * *